US012220056B2

(12) United States Patent
Liu

(10) Patent No.: US 12,220,056 B2
(45) Date of Patent: Feb. 11, 2025

(54) SHELF DEVICE

(71) Applicant: Taiwan Shin Yeh Enterprise Co., Ltd., Chu-Chee Hsiang (TW)

(72) Inventor: Hung-Tsun Liu, Chiayi (TW)

(73) Assignee: TAIWAN SHIN YEH ENTERPRISE CO., LTD., Chu-Chee Hsiang (TW)

( * ) Notice: Subject to any disclaimer, the term of this patent is extended or adjusted under 35 U.S.C. 154(b) by 6 days.

(21) Appl. No.: 18/463,552

(22) Filed: Sep. 8, 2023

(65) Prior Publication Data

US 2025/0000258 A1 Jan. 2, 2025

(30) Foreign Application Priority Data

Jun. 30, 2023 (TW) ..... 112206735

(51) Int. Cl.
*A47B 96/06* (2006.01)
*A47B 96/02* (2006.01)

(52) U.S. Cl.
CPC ..... *A47B 96/06* (2013.01); *A47B 96/02* (2013.01)

(58) Field of Classification Search
CPC ..... A47B 96/06; A47B 96/02
See application file for complete search history.

(56) References Cited

U.S. PATENT DOCUMENTS 2,746,780 A * 5/1956 Comino ..... A63H 33/12 52/690
4,928,834 A * 5/1990 Neiman ..... A47B 57/402 211/208
6,595,379 B1 * 7/2003 Powell ..... F16B 21/09 403/321
10,368,639 B1 * 8/2019 Lai ..... A47B 95/00
10,806,257 B1 * 10/2020 Liu ..... A47B 47/024
2014/0116973 A1 * 5/2014 Buckley ..... A47F 5/00 29/525.01
2020/0260871 A1 * 8/2020 Zhang ..... A47B 96/1408

FOREIGN PATENT DOCUMENTS

JP 2004329427 A * 11/2004
KR 20150133891 A * 12/2015

* cited by examiner

*Primary Examiner* — Eret C McNichols
*Assistant Examiner* — Ding Y Tan
(74) *Attorney, Agent, or Firm* — MUNCY, GEISSLER, OLDS & LOWE, P.C.

(57) ABSTRACT

A shelf device includes a plurality of support legs each formed with a plurality of elongated through holes, and at least one shelf unit. Each through hole is defined by two long edges and two short edges. The at least one shelf unit includes a plurality of crosspiece assemblies, and a plurality of mounting members each having a head portion with two long sides. Each mounting member is rotatable relative to one of the support legs and the corresponding crosspiece assembly between first and second states, in which the long sides of the head portion thereof are parallel to and are transverse to the long edges of a corresponding elongated through holes so as to permit insertion of and prevent removal of the head portion into and out of the corresponding through hole, respectively.

8 Claims, 13 Drawing Sheets

SHELF DEVICE

CROSS-REFERENCE TO RELATED APPLICATION

This application claims priority to Taiwanese Utility Model Patent Application No. 112206735, filed on Jun. 30, 2023.

FIELD

The present disclosure relates to a furniture, and more particularly to a shelf device that can be assembled and disassembled.

BACKGROUND

Referring to FIGS. 1 to 3, an existing shelf device includes four upright support legs 11, and a plurality of shelf units 12 assembled on the support legs 11 and spaced apart from each other in an up-down direction.

Each support leg 11 is formed with a plurality of spaced-apart mounting holes 111 extending therethrough in a front-rear direction. Each mounting hole 111 includes a large hole portion 112 and a small hole portion 113 communicating with each other.

Each shelf unit 12 includes two crosspiece assemblies 121 spaced apart from each other in the front-rear direction and extending in a left-right direction, a deck member 122 extending in the left-right direction and disposed across the crosspiece assemblies 121, and a plurality of mounting members 123 for mounting the crosspiece assemblies 121 on the support legs 11.

Each mounting member 123 includes a body portion 124 that is circular and that is connected to one end of a corresponding one of the crosspiece assemblies 121, and a head portion 125 that is circular, that is connected to the body portion 124, and that is spaced apart from the corresponding crosspiece assembly 121. The body portion 124 of each mounting member 123 has an outer diameter smaller than a hole diameter of the small hole portion 113 of a corresponding one of the mounting holes 111 so as to be inserted into the small hole portion 113. The head portion 125 of each mounting member 123 has an outer diameter smaller than a hole diameter of the large hole portion 112 of the corresponding mounting hole 111, but larger than the hole diameter of the small hole portion 113 thereof.

To assemble the existing shelf device, the head portion 125 of each mounting member 123 of each shelf unit 12 is first extended through the large hole portion 112 of the corresponding mounting hole 111 such that the body portion 124 of each mounting member 123 is inserted into the large hole portion 112 of the corresponding mounting hole 111. Next, the crosspiece assembly 121 is lowered so that the body portion 124 of each mounting member 123 is inserted into the small hole portion 113 of the corresponding mounting hole 111, thereby completing the assembly of one end of each crosspiece assembly 121 with a corresponding one of the support legs 11.

Although the existing shelf device has a feature of easy assembly, if there is a need to move the existing shelf device, a worker may use the shelf units 12 as point of application of force, causing the shelf units 12 to be raised relative to the support legs 11. As such, the body portion 124 of each mounting member 123 is likely to move from the small hole portion 113 to the large hole portion 112 of the corresponding mounting hole 111, thereby causing the head portion 125 of each mounting member 123 to disengage from the large hole portion 112 of the corresponding mounting hole 111 and thus causing the shelf units 12 to disengage from the support legs 11. Hence, there is still room for improvement of the existing shelf device.

SUMMARY

Therefore, an object of the present disclosure is to provide a shelf device that can alleviate at least one of the drawbacks of the prior art.

Accordingly, the shelf device of this disclosure includes a plurality of support legs and at least one shelf unit. Each support leg is formed with a plurality of elongated through holes extending in a longitudinal direction and spaced apart from each other in the longitudinal direction. Each elongated through hole is defined by two long edges and two short edges. The at least one shelf unit includes a plurality of crosspiece assemblies, and a plurality of mounting members mounting the crosspiece assemblies on the support legs. Each mounting member has a body portion inserted into one of the elongated through holes and one end of a corresponding one of the crosspiece assemblies, and a head portion connected to the body portion and having two long sides.

Each mounting member is rotatable relative to one of the support legs and the corresponding crosspiece assembly between a first state and a second state. When each mounting member is in the first state, the long sides of the head portion of each mounting member are parallel to the long edges of a corresponding one of the elongated through holes so as to permit insertion or removal of the head portion of each mounting member into or from the corresponding elongated through hole. When each mounting member is in the second state, the long sides of the head portion of each mounting member are transverse to the long edges of the corresponding elongated through hole so as to prevent the head portion of each mounting member from moving out of the corresponding elongated through hole.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
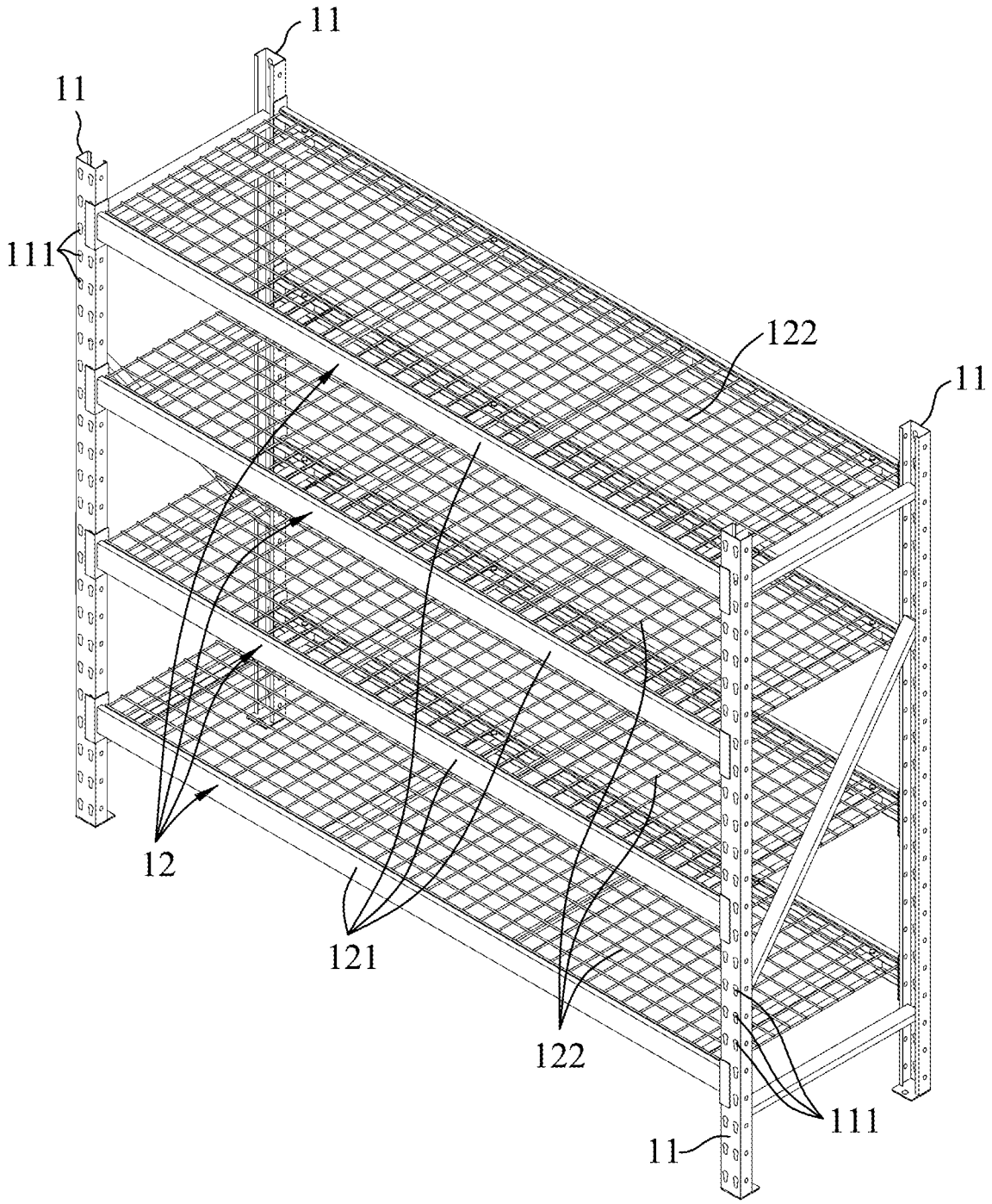
FIG.1 PRIOR ART
FIG. 1 is a perspective view of an existing shelf device.
Figure 2:
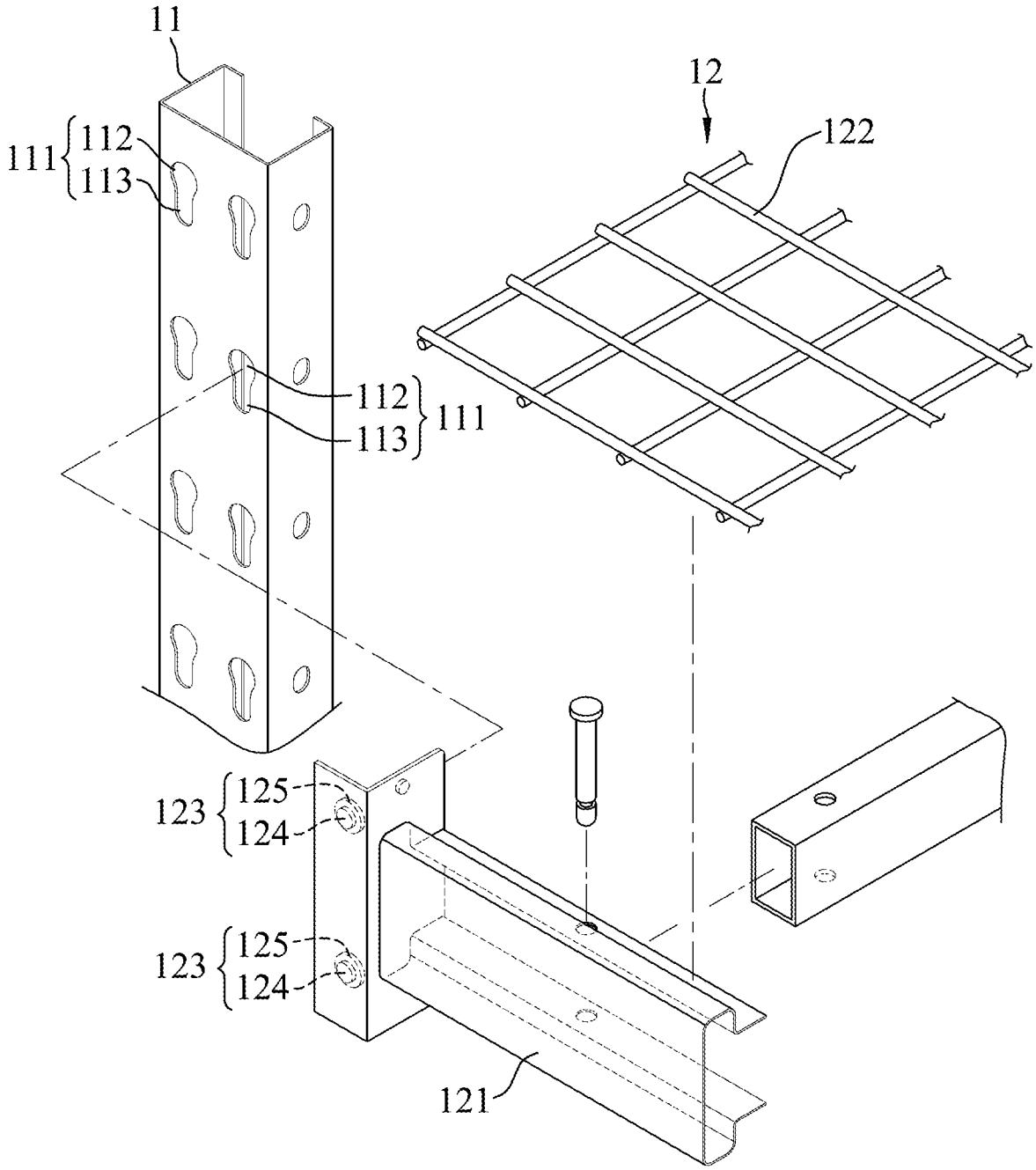
FIG.2 PRIOR ART
FIG. 2 is a fragmentary enlarged exploded perspective view of the existing shelf device.
Figure 3:
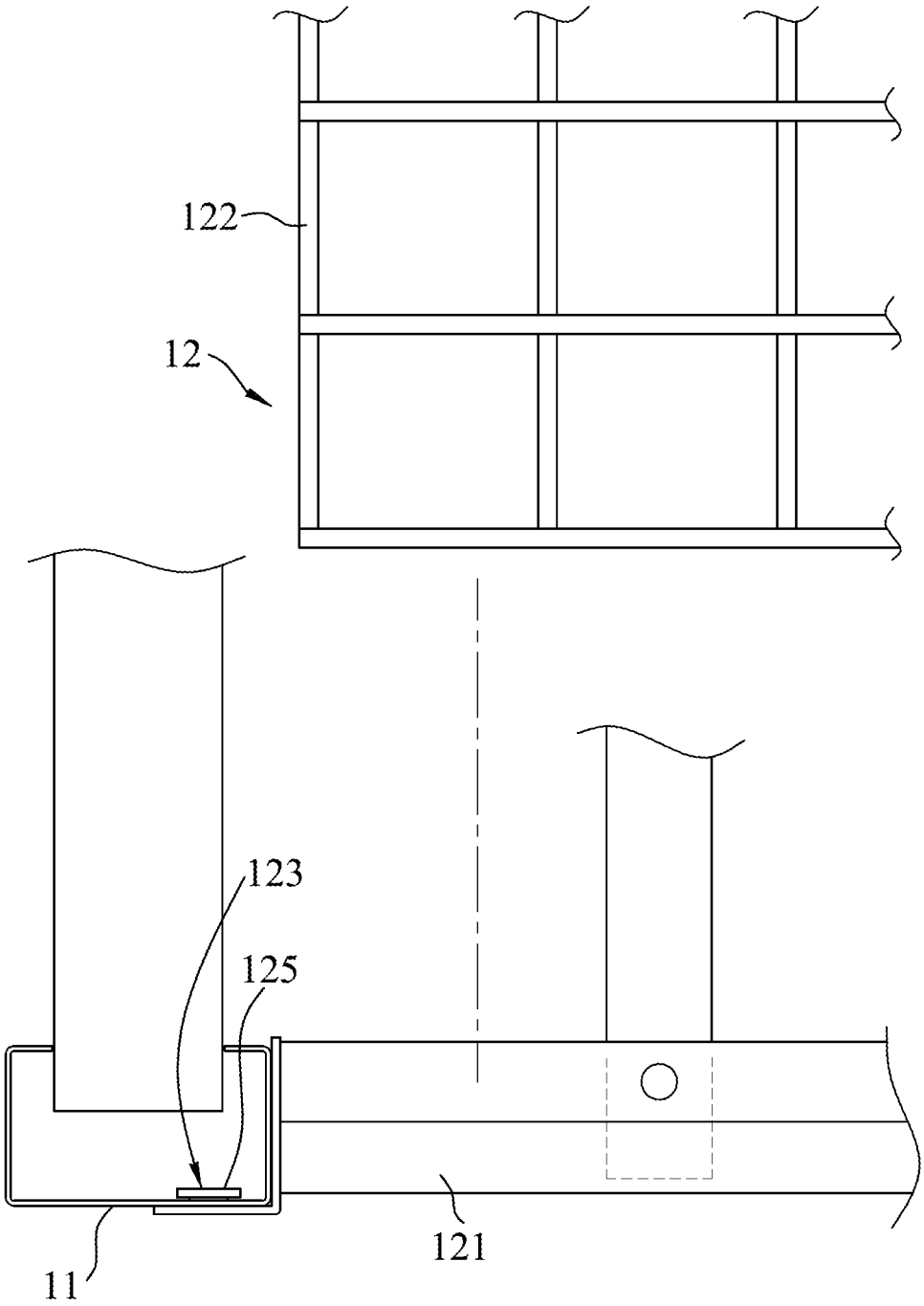
FIG.3 PRIOR ART
FIG. 3 is a fragmentary partly exploded top view of the existing shelf device.
Figure 4:
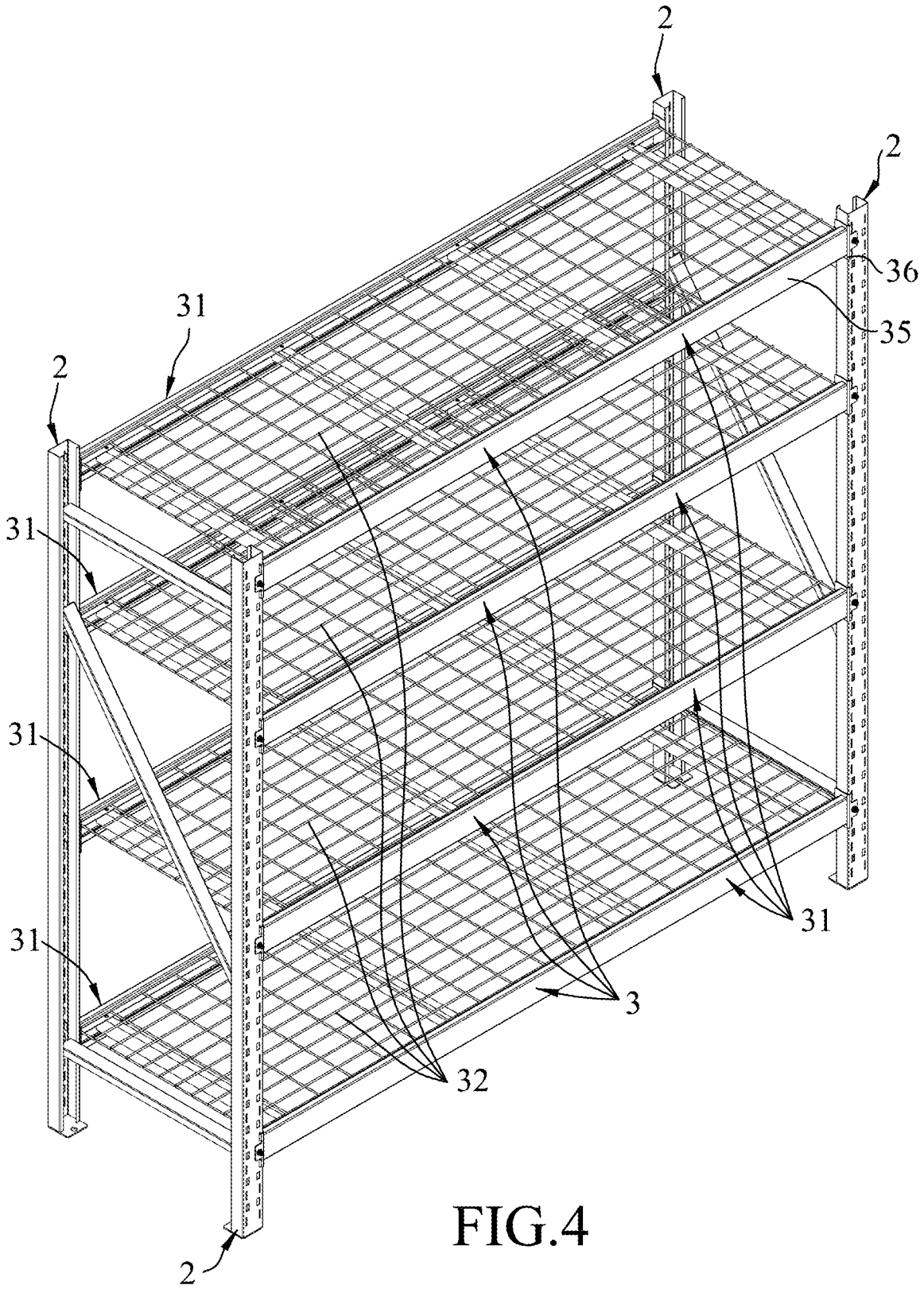
FIG. 4 is a perspective view of a shelf device according to an embodiment of the present disclosure.

Referring to FIGS. 4 to 7, a shelf device according to an embodiment of the present disclosure includes four spaced-apart support legs 2, and a plurality of shelf units 3 spaced apart from each other in an up-down direction and assembled on the support legs 2 such that the support legs 2 are located at four corners thereof and are supported on a support surface (e.g., ground).

Each support leg 2 has a generally C-shaped cross section, and includes a main leg portion 21, and two side leg portions 22 respectively connected to left and right ends of the main leg portion 21 and extending in a front-rear direction. The main leg portion 21 includes a plurality of elongated through holes 23 arranged in two vertical rows which are spaced apart from each other in a left-right direction, and a plurality of insert holes 24 arranged in two vertical rows and staggered with the elongated through holes 23 in the up-down direction.

The elongated through holes 23 in each vertical row are spaced apart from each other in the up-down direction. Each elongated through hole 23 has a rectangular shape extending in a longitudinal direction (D11), and is defined by two long edges 231 and two short edges 232. The longitudinal direction (D11) corresponds to the up-down direction. The long edges 231 extend in the longitudinal direction (D11), while the short edges 232 extend in the left-right direction. The insert holes 24 in each vertical row are also spaced apart from each other in the up-down direction. Each insert hole 24 is an elongated slot that extends in the longitudinal direction (D11) and that is defined by two long edges 241 and two short edges 242. Each insert hole 24 has a hole width (W11) (see FIG. 8) measured in the left-right direction smaller than a hole width (W12) (see FIG. 8) measured in the left-right direction of each elongated through hole 23. Each two adjacent insert holes 24 in each vertical row are located on top and bottom sides of a corresponding one of the elongated through holes 23. Specifically, the insert holes 24 and the elongated through holes 23 in each vertical row are alternately arranged in a staggered manner in the up-down direction.

In this embodiment, four shelf units 3 are exemplified. Since the structures of the shelf units 3 are the same, only one of the shelf units 3 will be described in detail below for the sake of brevity.

Figure 5:
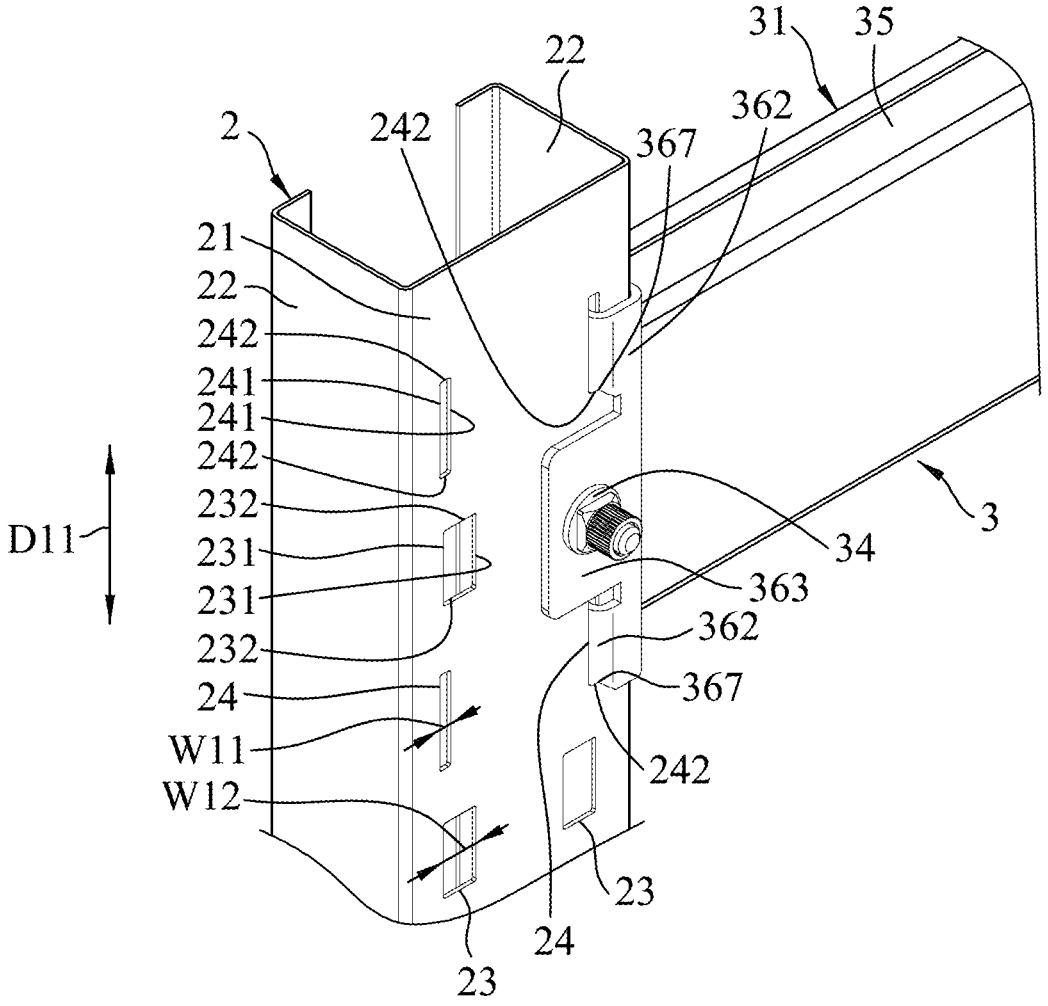
FIG. 5 is a fragmentary enlarged perspective view of an assembly of a support leg and a crosspiece assembly of a shelf unit of the embodiment.
Figure 6:
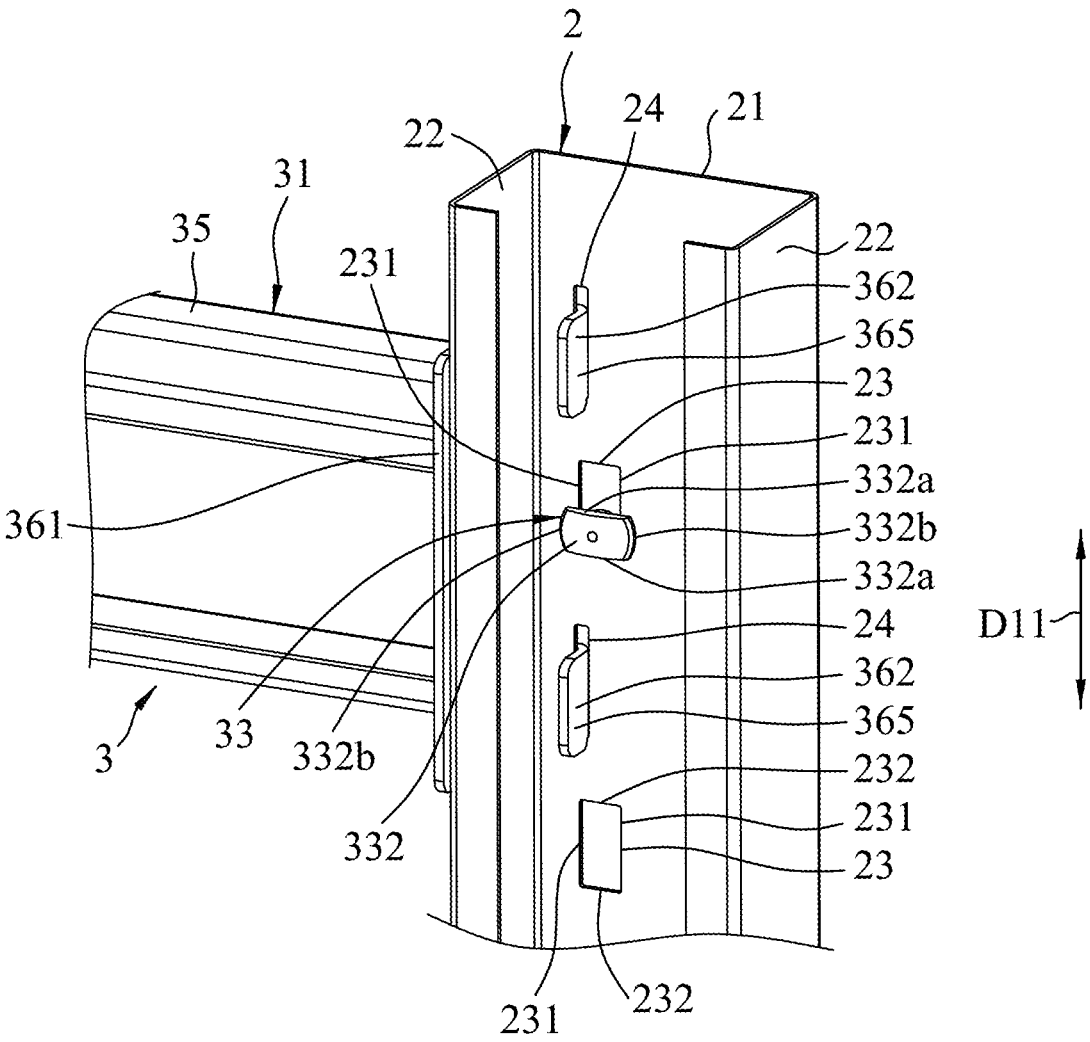
FIG. 6 is another fragmentary enlarged perspective view of the assembly of the support leg and the crosspiece assembly of the embodiment taken from another angle.
Figure 7:
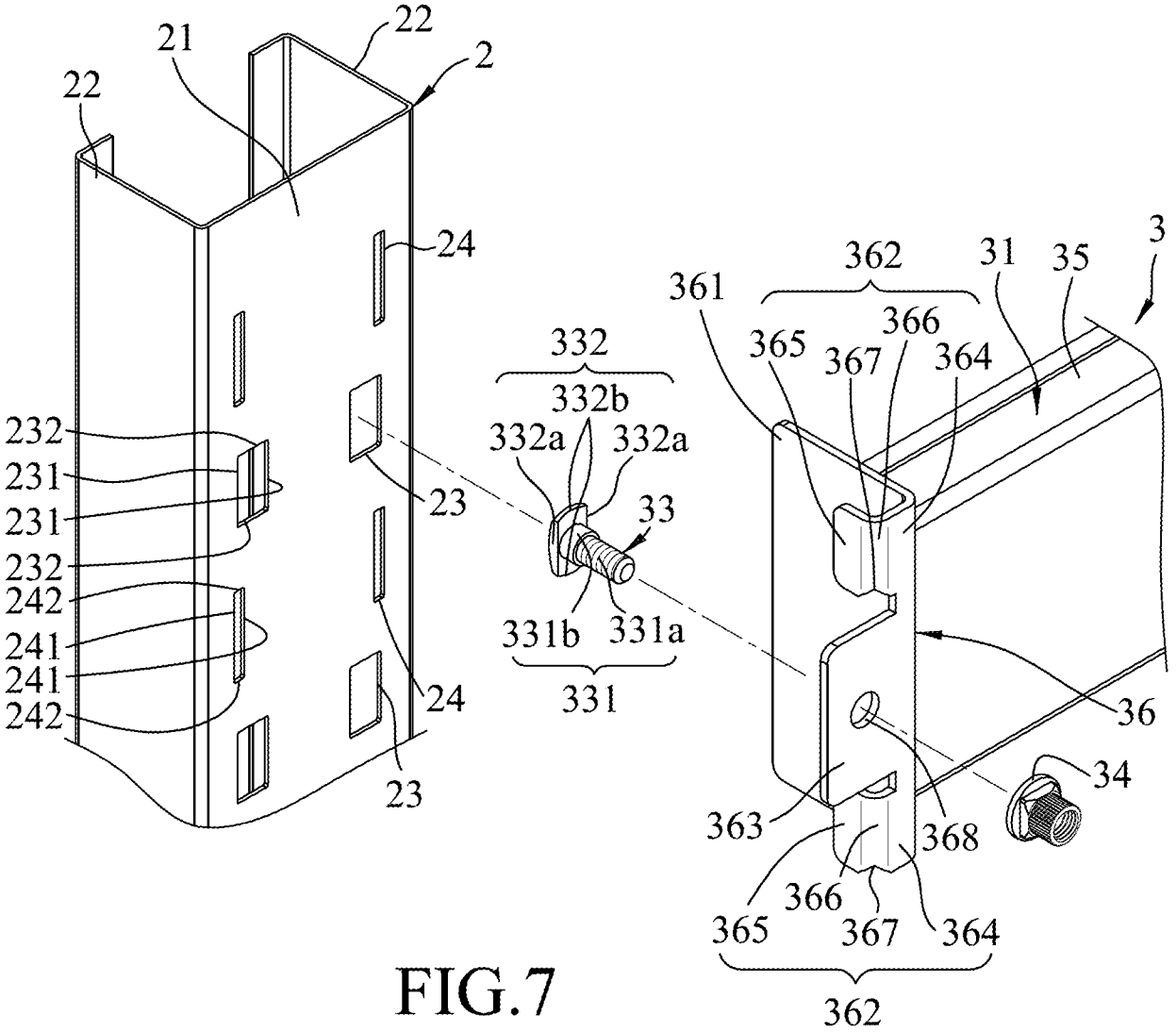
FIG. 7 is a fragmentary enlarged exploded perspective view, illustrating relations among the support leg, a mounting member, the crosspiece assembly, and a nut of the embodiment.

The shelf unit 3 includes two crosspiece assemblies 31 extending in the left-right direction and spaced apart from each other in the front-rear direction, a deck member 32 extending in the left-right direction and disposed across the crosspiece assemblies 31 in the front-rear direction, four mounting members 33 (because the front, rear, left, and right sides of the shelf unit 3 are symmetrical, only one mounting member 33 is shown in FIGS. 5 to 7) for mounting the crosspiece assemblies 31 on the support legs 2, and four nuts 34 (only one is shown in FIGS. 5 and 7) for threadedly and respectively engaging the mounting members 33.

Each crosspiece assembly 31 includes a crosspiece 35 extending in the left-right direction, and two end plates 36 (only one is visible in FIG. 4) respectively welded to opposite left and right ends of the crosspiece 35. The crosspiece 35 is used to support one side of the deck member 32 (see FIG. 4). Since the structure of the crosspiece 35 is known in the art, a detailed description thereof is dispensed herewith.

Each end plate 36 includes a main plate portion 361 having a rectangular shape and welded to the respective one of the left and right ends of the crosspiece 35, two first insert plate portions 362 connected to a front end of the main plate portion 361 and spaced apart from each other in the up-down direction, and a second insert plate portion 363 connected to the front end of the main plate portion 361 and located between the first insert plate portions 362.

With reference to FIG. 7, each first insert plate portion 362 includes a connecting section 364 connected to the front end of the main plate portion 361 and extending in the left-right direction, a curved section 366 extending curvedly and rearwardly from an end of the connecting section 364 that is opposite to the main plate portion 361, and an insertion section 365 extending rearwardly from an end of the curved section 366 that is opposite to the connecting section 364 and inserted into a corresponding one of the insert holes 24. The curved section 366 is formed with a notch 367 extending inwardly from a bottom edge thereof for engagement with one of the short edges 242 of the corresponding insert hole 24. The second insert plate portion 363 has a generally square shape, extends transversely and outwardly from the front end of the main plate portion 361, and is formed with a circular through hole 368.

Figure 8:
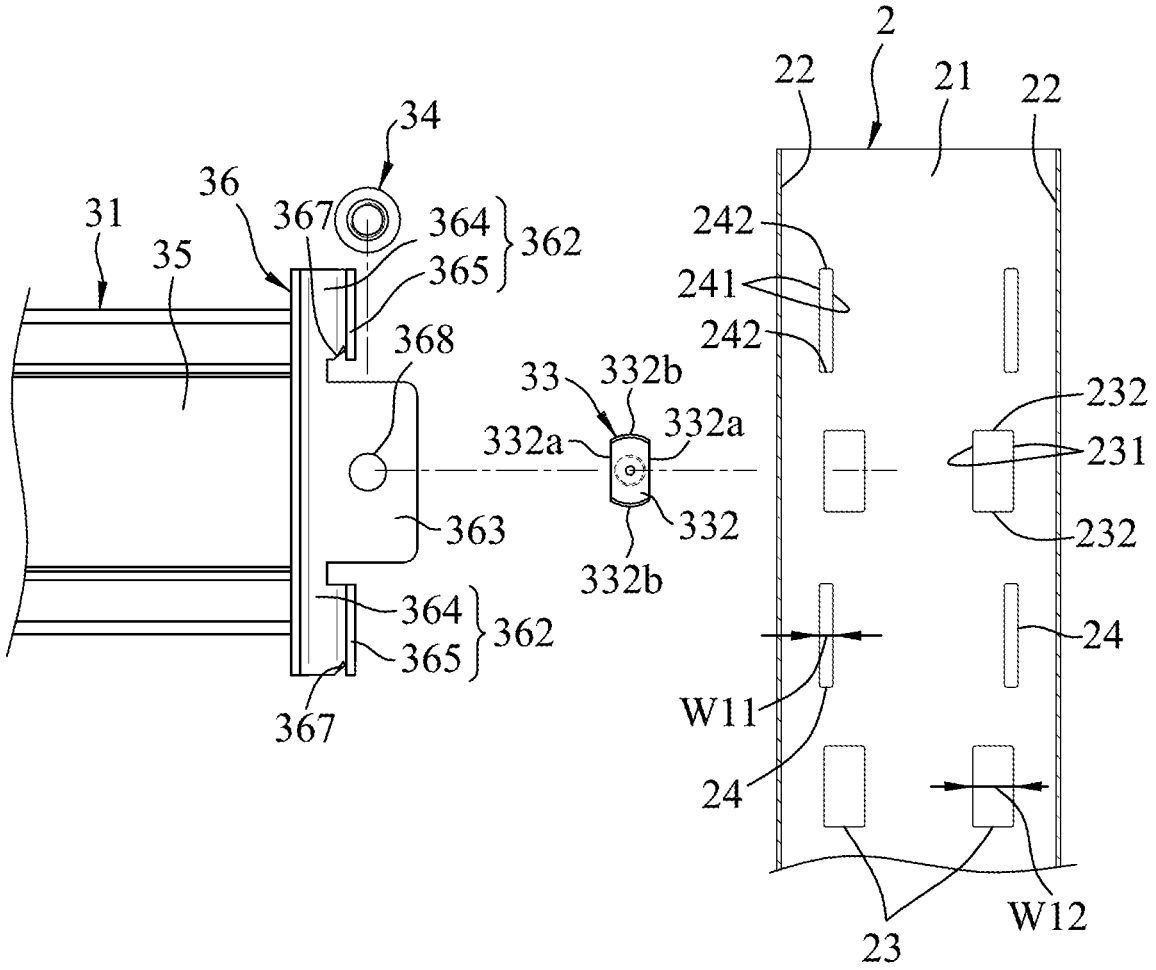
FIG. 8 is a fragmentary enlarged exploded sectional view, illustrating the relations among the support leg, the mounting member, the crosspiece assembly, and the nut of the embodiment as viewed from back to front.
Figure 9:
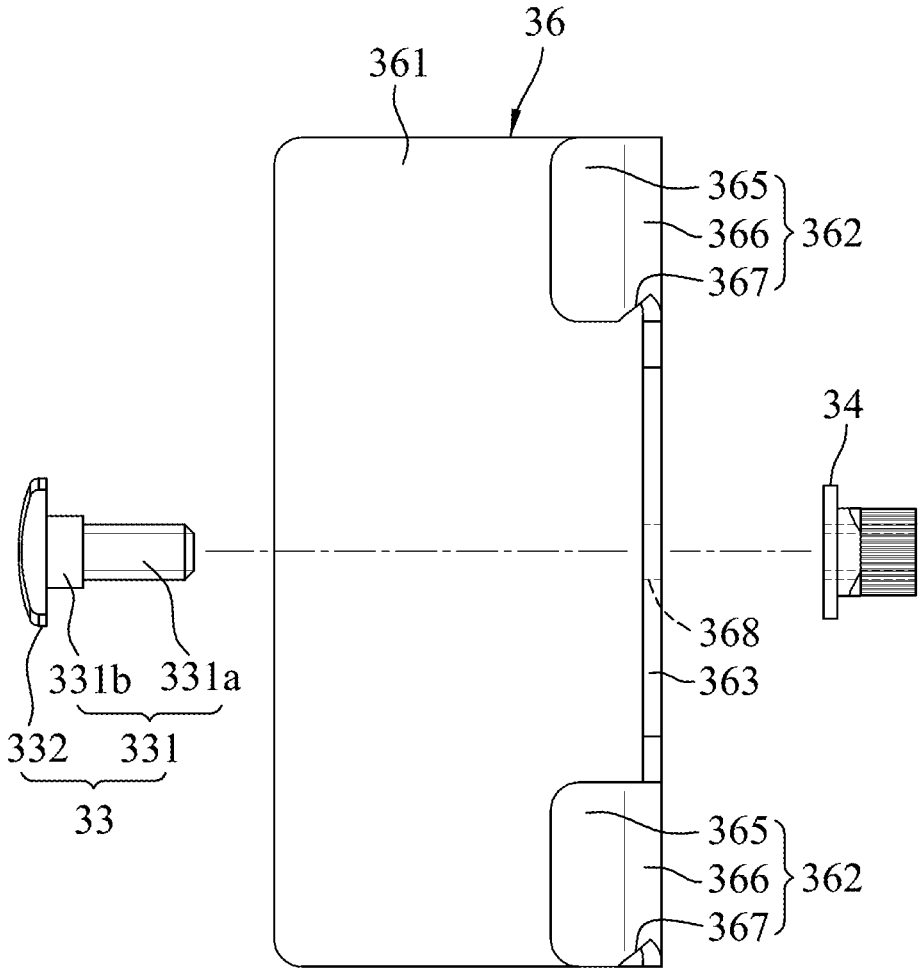
FIG. 9 is a side view of the mounting member, the nut, and an end plate of the embodiment.

Referring to FIGS. 8 and 9, in combination with FIG. 7, since each mounting member 33 must be rotated to pass through a corresponding one of the elongated through holes 23, the direction of the mounting member 33 shown in FIGS. 7 to 9 is different from the direction of the mounting member 33 shown in FIG. 6. The detail as to how each mounting member 33 can pass through the corresponding elongated through hole 23 will be described in the following paragraphs.

Each mounting member 33 has a columnar body portion 331, and a solid head portion 332 connected to the body portion 331. The body portion 331 is insertable into one of the elongated through holes 23 in the main leg portion 21 and the through hole 368 in the second insert plate portion 363 of one of the end plates 36 of a corresponding one of the crosspiece assemblies 31. The body portion 331 includes an external thread section (331*a*) engageable with a respective one of the nuts 34, and a neck section (331*b*) connected between the external thread section (331*a*) and the head portion 332. The neck section (331*b*) has an outer diameter slightly larger than an outer diameter of the external thread section (331*a*).

As shown in FIGS. 7 and 8, the head portion 332 has two long sides (332*a*) spaced apart from each other in the left-right direction and extending in the up-down direction, and two short sides (332*b*) connected between the long sides (332*a*). The head portion 332 has a thickness gradually increasing from the two short sides (332*b*) toward a central portion thereof (see FIG. 9). Each long side (332*a*) is shorter than each first long edge 231, but longer than each short edge 232. Each short side (332*b*) is shorter than each short edge 232. That is, the size of the head portion 332 is smaller than that of the elongated through hole 23.

Figure 10:
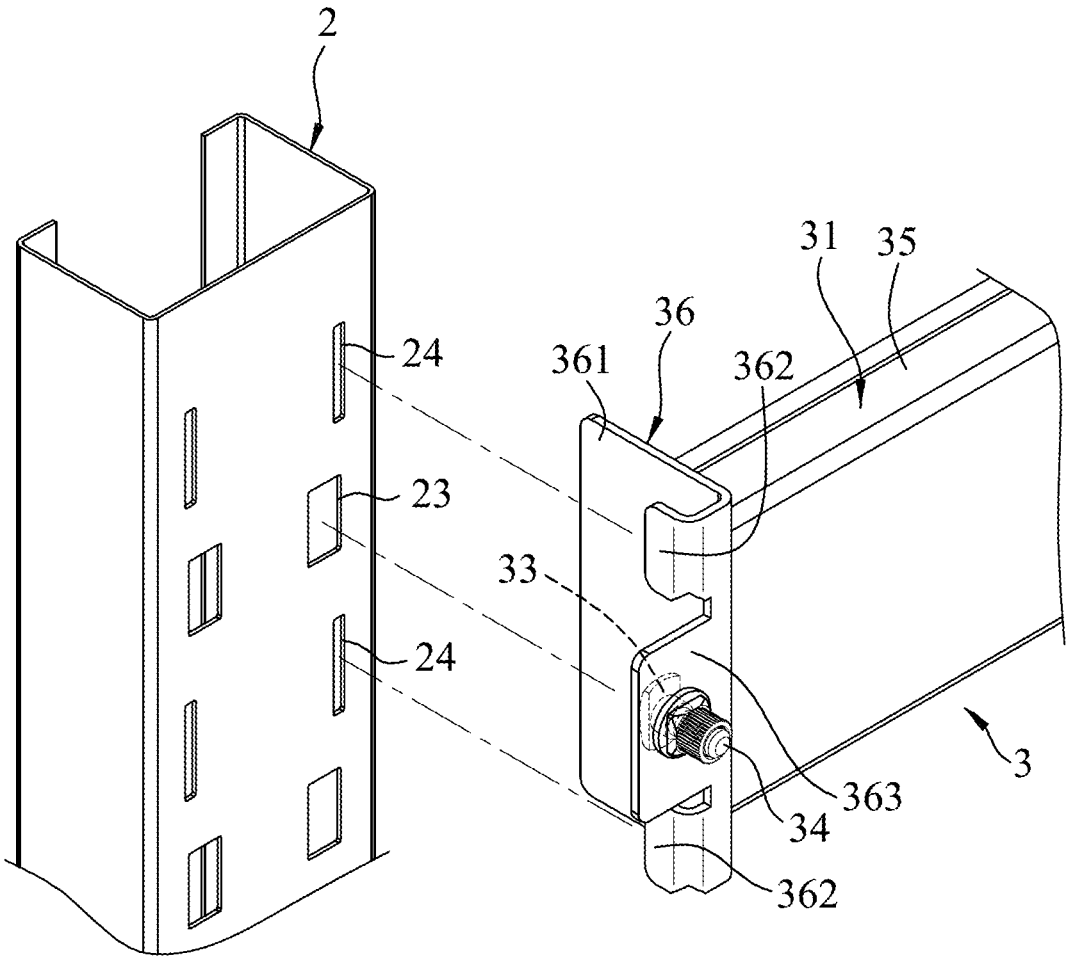
FIG. 10 is a view similar to FIG. 7, but with the mounting member and the nut engaged to a second insert plate portion of the end plate.
Figure 11:
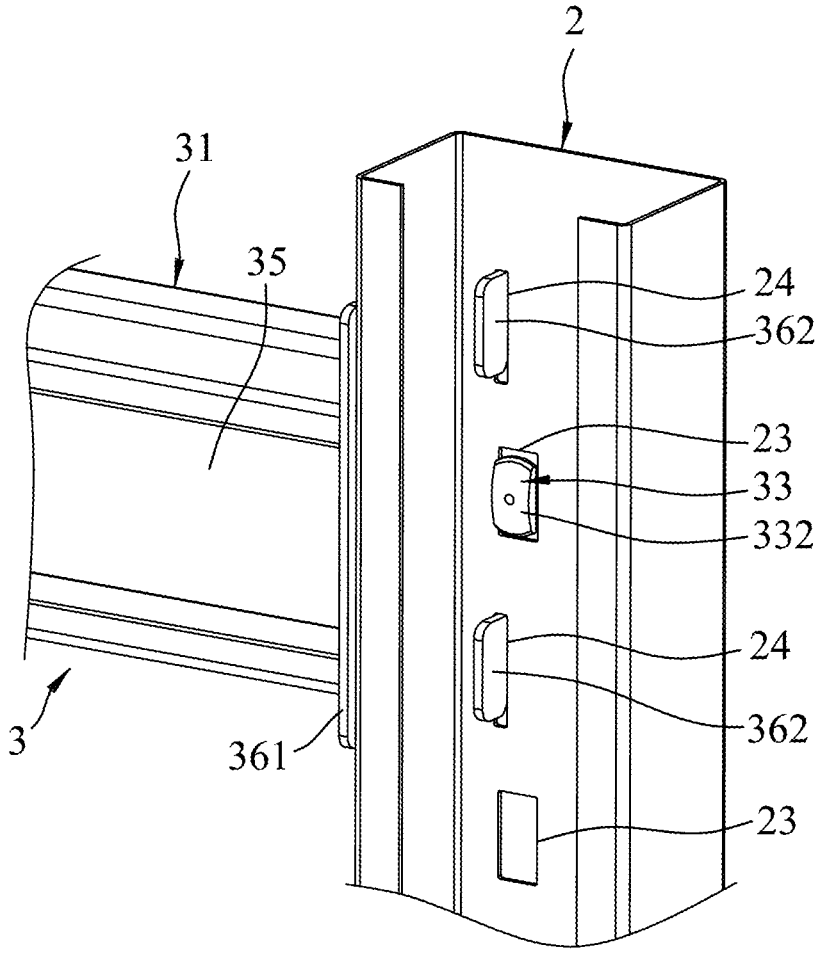
FIG. 11 is a view similar to FIG. 6, but with the mounting member being rotated such that a head portion thereof is aligned with an elongated through hole in the support leg.

Referring to FIGS. 10 and 11, in combination with FIG. 7, an assembly method of this embodiment will be described herein. Since the four corners of each shelf unit 3 are assembled on the support legs 2 in the same manner, only one corner of the shelf unit 3 assembled on one support leg 2 will be described hereinafter for the sake of brevity.

During assembly, the body portion 331 of the mounting member 33 is first inserted into the through hole 368 of the second insert plate portion 363 of the end plate 36, and the nut 34 is threaded to the external thread section (331*a*) of the body portion 331. As such, the mounting member 33 and the nut 34 are mounted on the end plate 36, as shown in FIG. 10, and the head portion 332 of the mounting member 33 and the nut 34 are respectively located at rear and front sides of the second insert plate portion 363.

Next, the head portion 332 of the mounting member 33 is aligned with one of the elongated through holes 23, and the first insert plate portions 362 of the end plate 36 are respectively aligned with the two insert holes 24 located on top and bottom sides of the one of the elongated through holes 23. Then, the mounting member 33 is inserted into the elongated through hole 23 with the head portion 332 thereof extending out of the elongated through hole 23, and the first insert plate portions 362 are inserted into the respective insert holes 24, as shown in FIG. 11.

Figure 12:
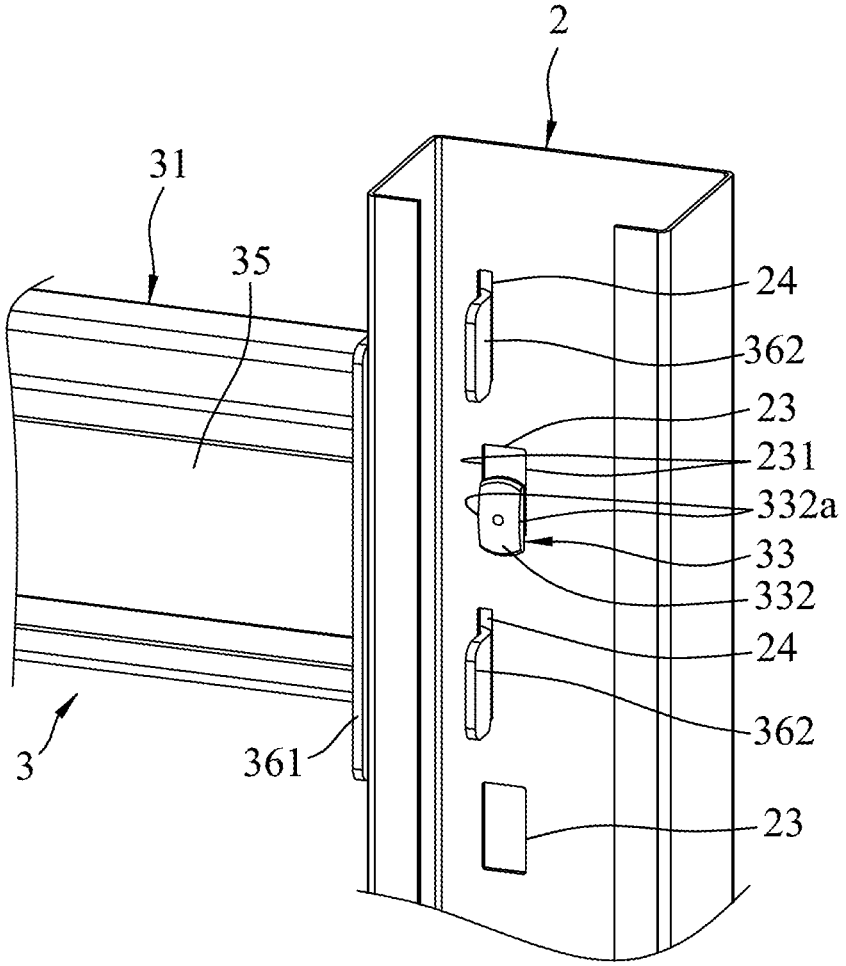
FIG. 12 is a view similar to FIG. 11, but with the crosspiece assembly being moved downward relative to the support leg.
Figure 13:
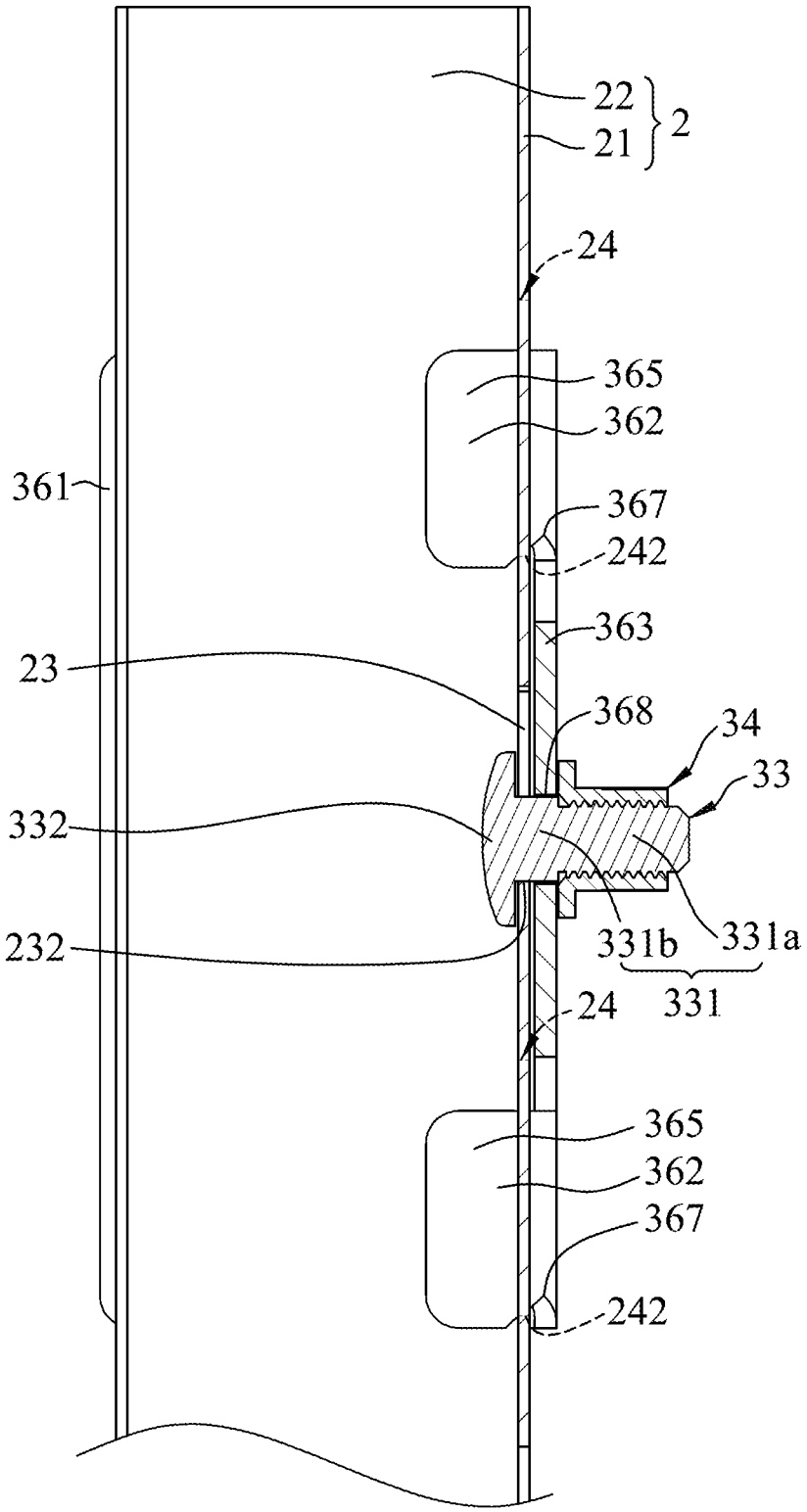
FIG. 13 is a fragmentary enlarged sectional view, illustrating how the end plate is assembled on the support leg.

Referring to FIGS. 12 and 13, in combination with FIG. 11, after the mounting member 33 and the first insert plate portions 362 are inserted into the elongated through hole 23 and the insert holes 24, respectively, the crosspiece 35 is moved downwardly relative to the support leg 2 to drive the end plate 36 to also move downwardly relative to the support leg 2. That is, the mounting member 33 and the first and second insert plate portions 362, 363 are driven to move downwardly, as shown in FIGS. 12 and 13, so that a lower one of the short edges 232 of the elongated through hole 23 is clamped between the head portion 332 of the mounting member 33 and the second insert plate portion 363, and lower ones of the short edges 242 of the insert holes 24 are received in the notches 367 of the respective first insert plate portions 362.

With reference to FIGS. 6, 11 and 12, finally, the mounting member 33 is rotated relative to the support leg 2 and the end plate 36 of the crosspiece assembly 31 to change the mounting member 33 from a first state shown in FIG. 12 to a second state shown in FIG. 6, thereby completing the assembly.

In the second state, the long sides (332*a*) of the head portion 332 of the mounting member 33 are transverse to the long edges 231 of the elongated through hole 23, so that the long sides (332*a*) of the head portion 332 are limited by the two long edges 231 of the elongated through hole 23, thereby preventing the head portion 332 of the mounting member 33 from moving out of the elongated through hole 23.

To disassemble the present embodiment, the mounting member 33 is rotated relative to the support leg 2 and the end plate 36 of the crosspiece assembly 31 to restore the mounting member 33 from the second state shown in FIG. 6 to the first state shown in FIG. 12. In the first state, the long sides (332*a*) of the head portion 332 of the mounting member 33 are parallel to the long edges 231 of the elongated through hole 23 so as to permit removal of the head portion 332 of the mounting member 33 from the elongated through hole 23.

Next, the crosspiece 35 is slightly lifted relative to the support leg 2, so that the head portion 332 of the mounting member 33 and the first insert plate portions 362 of the end plate 36 are aligned with the elongated through hole 23 and the insert holes 24, respectively, as shown in FIG. 11. Afterwards, the head portion 332 of the mounting member 33 is moved out of the elongated through hole 23, and the first insert plate portions 362 of the end plate 36 are also moved out of the respective insert holes 24, thereby separating the crosspiece assembly 31 from the support leg 2, as shown in FIG. 10.

The features of this embodiment reside in that, when the head portion 332 of each mounting member 33 is in the second state, separation of each crosspiece assembly 31 from the corresponding support legs 2 can be prevented; and when the head portion 332 of each mounting member 33 is in the first state, each crosspiece assembly 31 can be separated from the corresponding support legs 2. Hence, assembly and disassembly of the shelf device of this disclosure are very convenient, and the assembled structure is relatively stable.

In summary, the effect of the shelf device of this disclosure resides in that, since the long sides (332*a*) of the head portion 332 of each mounting member 33 are limited by the two long edges 231 of the corresponding elongated through hole 23 in the second state, the head portion 332 of each mounting member 33 cannot be moved out of the corresponding elongated through hole 23. Even if each mounting member 33 is moved up and down along the corresponding elongated through hole 23 during transport, the head portion 332 of each mounting member 33 will not be separated from the corresponding elongated through hole 23, so that there will be no problem of loose or collapsed structure due to transport. Therefore, the object of this disclosure can indeed be achieved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A shelf device, comprising:

a plurality of support legs, each of said support legs being formed with a plurality of elongated through holes extending in a longitudinal direction and spaced apart from each other in the longitudinal direction, each of said elongated through holes being defined by two long edges and two short edges; and at least one shelf unit including a plurality of crosspiece assemblies, and a plurality of mounting members mounting said crosspiece assemblies on said support legs, each of said mounting members having a body portion inserted into one of said elongated through holes and one end of a corresponding one of said crosspiece assemblies, and a block portion connected to said body portion and having two long sides;

wherein each of said mounting members is rotatable relative to one of said support legs and said corresponding one of said crosspiece assemblies between a first state and a second state;

wherein, when each of said mounting members is in said first state, said long sides of said head portion of each of said mounting members are parallel to said long edges of a corresponding one of said elongated through holes so as to permit insertion or removal of said head portion of each of said mounting members into or from said corresponding one of said elongated through holes; and wherein, when each of said mounting members is in said second state, said long sides of said head portion of each of said mounting members are transverse to said long edges of said corresponding one of said elongated through holes so as to prevent said head portion of each of said mounting members from moving out of said corresponding one of said elongated through holes.

2. The shelf device as claimed in claim 1, wherein each of said support legs is further formed with a plurality of insert holes arranged in staggered relation with said elongated through holes in an up-down direction, the longitudinal direction corresponding to the up-down direction, each of said crosspiece assemblies including a crosspiece extending in a left-right direction, and two end plates respectively connected to opposite left and right ends of said crosspiece, each of said end plates including a main plate portion connected to a respective one of said opposite left and right ends of said crosspiece, and two first insert plate portions connected to one end of said main plate portion and spaced apart from each other in the up-down direction, each of said first insert plate portions including a connecting section connected to said one end of said main plate portion and extending in the left-right direction, and an insertion section that is opposite to said connecting section, that extends in a front-rear direction, and that is inserted into a corresponding one of said insert holes.

3. The shelf device as claimed in claim 2, wherein each of said insert holes extends in the longitudinal direction, and is defined by two long edges and two short edges, each of said first insert plate portions further including a curved section connected between said connecting section and said insertion section and formed with a notch that extends inwardly from a bottom edge of said curved section and that engages one of said short edges of said corresponding one of said insert holes.

4. The shelf device as claimed in claim 2, wherein each of said end plates further includes a second insert plate portion connected to said one end of said main plate portion and located between said first insert plate portions, said second insert plate portion being formed with a through hole for insertion of said body portion of a respective one of said mounting members therein.

5. The shelf device as claimed in claim 4, wherein said body portion of each of said mounting members includes an external thread section, said at least one shelf unit further including a plurality of nuts respectively engaged with said external thread sections of said body portions of said mounting members, each of said nuts and said head portion of a respective one of said mounting members being respectively located at two opposite sides of said second insert plate portion.

6. The shelf device as claimed in claim 2, wherein each of said insert holes has a hole width measured in the left-right direction smaller than a hole width measured in the left-right direction of each of said elongated through holes.

7. The shelf device as claimed in claim 1, wherein said head portion of each of said mounting members further has two short sides connected between said two long sides, said head portion having a thickness gradually increasing from said two short sides toward a central portion of said head portion.

8. The shelf device as claimed in claim 1, wherein said body portion of each of said mounting members has a columnar shape.

* * * * *